US012078020B2

(12) United States Patent
Hughes

(10) Patent No.: US 12,078,020 B2
(45) Date of Patent: Sep. 3, 2024

(54) DOWNHOLE MECHANICAL ACTUATOR

(71) Applicant: Hughes Tool Company LLC, Highlands Ranch, CO (US)

(72) Inventor: William James Hughes, Highlands Ranch, CO (US)

(73) Assignee: Hughes Tool Company LLC, Highlands Ranch, CO (US)

( * ) Notice: Subject to any disclaimer, the term of this patent is extended or adjusted under 35 U.S.C. 154(b) by 121 days.

(21) Appl. No.: 17/709,210

(22) Filed: Mar. 30, 2022

(65) Prior Publication Data

US 2022/0316289 A1 Oct. 6, 2022

Related U.S. Application Data

(60) Provisional application No. 63/170,025, filed on Apr. 2, 2021.

(51) Int. Cl.

| | |
|---|---|
| ***E21B 21/08*** | (2006.01) |
| ***E21B 33/04*** | (2006.01) |
| ***E21B 33/047*** | (2006.01) |
| ***E21B 33/06*** | (2006.01) |
| ***E21B 34/02*** | (2006.01) |
| ***E21B 34/12*** | (2006.01) |

(52) U.S. Cl.

CPC ..... *E21B 21/08* (2013.01); *E21B 33/0415* (2013.01); *E21B 33/047* (2013.01); *E21B 33/06* (2013.01); *E21B 34/025* (2020.05); *E21B 34/12* (2013.01); *E21B 2200/05* (2020.05); *E21B 2200/06* (2020.05)

(58) Field of Classification Search

CPC .... E21B 21/08; E21B 33/0415; E21B 33/047; E21B 33/06; E21B 33/085; E21B 34/025; E21B 34/12; E21B 2200/06

See application file for complete search history.

(56) References Cited

U.S. PATENT DOCUMENTS

| | | | | |
|---|---|---|---|---|
| 4,433,702 | A | 2/1984 | Baker | |
| 5,429,188 | A | 7/1995 | Cameron et al. | |
| 6,745,842 | B2 | 6/2004 | Hughes | |
| 11,255,144 | B2 | 2/2022 | Hughes | |
| 2013/0341034 | A1* | 12/2013 | Biddick | F16K 1/2007 166/373 |
| 2015/0204144 | A1* | 7/2015 | Mullins | E21B 17/02 166/208 |
| 2018/0195361 | A1* | 7/2018 | Senger | E21B 33/062 |
| 2018/0216417 | A1* | 8/2018 | Escobedo | E21B 17/05 |

FOREIGN PATENT DOCUMENTS

WO WO 2021/118895 A1 6/2021

* cited by examiner

*Primary Examiner* — Jonathan Malikasim
*Assistant Examiner* — Nicholas D Wlodarski
(74) *Attorney, Agent, or Firm* — Michael Reilly LLC; Michael D. Reilly

(57) ABSTRACT

Disclosed herein are various embodiments of well control system for drilling an oil or gas well safely and efficiently by providing a mechanical actuator capable of transmitting a rotational force downhole, and converting the rotational force to an axial force for the purpose of operating downhole equipment, including subsurface safety valves, compressible bladder valves, and sliding sleeve valves. Because the actuator is mechanical and not hydraulic as in conventional equipment, the force applied is independent of the depth at which it is applied, overcoming a major deficiency seen in comparable hydraulic systems.

11 Claims, 6 Drawing Sheets

DOWNHOLE MECHANICAL ACTUATOR

CROSS REFERENCE TO RELATED APPLICATIONS

This application claims the benefit under 35 U.S.C. § 119(e) of U.S. Provisional Patent Application No. 63/170,025, entitled "Downhole Mechanical Actuator" to William James Hughes, filed on Apr. 2, 2021, which is hereby incorporated by reference in its entirety.

This application is related to U.S. Utility Patent No. 11,255,144 entitled "Annular Pressure Cap Drilling Method" to William James Hughes, issued on Feb. 22, 2022, and referred to hereinafter the "144 patent".

This application is related to PCT International Patent Application No. PCT/US2020/063522 entitled "Annular Pressure Cap Drilling Method" to William James Hughes, filed on Dec. 6, 2020. This application was published as WO 2021/118895 on Jun. 17, 2021.

FIELD

Various embodiments described herein relate to drilling oil and gas wells, and devices, systems and methods associated therewith.

BACKGROUND

When producing oil and gas while drilling, it is often necessary to perform various operations to control the flow of returning drilling and produced fluids. Examples of such operations include diverting the flow, blocking the flow to allow maintenance operations to be performed at or near the wellhead, opening and closing valves, which may in some cases be subsurface safety valves. For some operations, the control equipment may be located at or proximate to the wellhead. For other operations, the flow is controlled downhole, sometimes at considerable depths.

These operations require the application of force to move mechanical elements, sometimes against considerable static and dynamic pressures. A frequently used approach is to apply hydraulic force to operate a downhole mechanism. There are several disadvantages to this approach. It requires high pressure hydraulic equipment and lines on or near the rig floor which poses a safety hazard for the rig operators. It requires that hydraulic lines be attached to casing where they may be exposed to abrasion and corrosive fluids. The most serious drawback is that the required force from hydraulic pressure is only effective for a limited distance downhole. In some cases, the hydraulic pressure has to overcome not only any mechanical or frictional resistance, but also, for example, a large pressure differential between the upper and lower surfaces of a flapper valve. As the mechanisms to be operated are located deeper, the available hydraulic pressure falls off, until it is insufficient to operate the downhole equipment.

The use of hydraulic equipment is often further complicated by the need to operate a downhole mechanism in two directions. For example, a safety valve may be opened by hydraulic pressure, but when the valve has to be closed, releasing the hydraulic pressure and allowing the pressure to bleed off in order to close the valve may take time. The downhole mechanism includes devices such as springs to assist the valve in closing. Unfortunately, using a powerful spring exacerbates the problem of hydraulic pressure falloff with distance, as now opening the valve requires sufficient hydraulic force to overcome both downhole fluid pressure and the resistance of the spring. It is possible to design two way hydraulic valves, capable of both opening and closing a downhole mechanism. Doing so, of course, adds extra complexity and another point of failure, as it would require a second hydraulic line.

An alternative approach is the use of electric motors to operate downhole equipment, but this requires running electric cables on the outside of the casing. These cables must be protected to prevent damage. There is no problem with distance, and in most cases, electrical motors can be operated in either direction. Electric power is sometimes used to operate drills and pumps, but is much less favored for operating valves and other flow control devices during underbalanced drilling operations.

Rotating wellheads can operate downhole equipment such as a string of production tubing which requires only rotational motion. However, many downhole mechanisms require axial motion, that is, motion up and down the wellbore.

One mechanism which does provide axial motion is the casing jack, an example of which is provided in U.S. Pat. No. 6,745,842 to Hughes et al., entitled "Concentric Casing Jack", the disclosure of which is incorporated herein by reference in its entirety. The two drawbacks with the casing jack are its height, approximately six 6 feet, and dealing with casing stretch. The jack has to first pull the stretch out of the string before the actuator will move. In reverse, the stretch in the string has to be released before the actuator will move down.

What is needed is a reliable, precisely controllable and robust means of transmitting rotational force downhole and converting it to a range of axial motion in two directions without the need to run hydraulic lines or electrical cables inside the casing, capable of exerting a force which is not restricted by the depth at which the force is applied.

SUMMARY

In one embodiment, there is provided a system for applying an axial force downhole in a well comprising: a rotating wellhead; a casing having an upper end and a lower end, the upper end attached to and rotating with the rotating wellhead; a mechanical actuator housing having a rotatable upper member attached to the lower end of the casing and rotating with the casing and a lower section which does not rotate, the upper member rotatably connected to the lower section by an adjustable rotary union; a linear motion mechanical actuator connected to the rotatable upper member of the mechanical actuator housing by an upper joint which transfers torque while allowing for extension wherein the rotation of the rotating wellhead is transferred through the casing and upper member of the mechanical actuator housing via the upper joint to the linear motion mechanical actuator and the lower section of the mechanical actuator housing is supported by a tie-back liner through a lower joint which transfers torque while allowing for extension to prevent rotation and to laterally stabilize the lower section of the mechanical actuator housing.

In another embodiment, there is provided a sub-surface safety valve assembly comprising: a rotating wellhead; a casing a casing having an upper end and a lower end, the upper end attached to and rotating with the rotating wellhead; a mechanical actuator housing having a rotatable upper member attached to the lower end of the casing and rotating with the casing and a lower section which does not rotate, the upper member rotatably connected to the lower section by an adjustable rotary union; a linear motion mechanical actuator connected to the rotatable upper member of the mechanical actuator housing by a joint which transfers torque while allowing for extension wherein the rotation of the rotating wellhead is transferred through the casing and upper member of the mechanical actuator housing via the joint to the linear motion mechanical actuator, the linear motion mechanical actuator having a hollow cylindrical actuator and a hinged flapper valve disposed within the casing such that downward motion of the hollow cylindrical actuator opens the flapper valve.

Further embodiments are disclosed herein or will become apparent to those skilled in the art after having read and understood the specification and drawings hereof.

BRIEF DESCRIPTION OF THE DRAWINGS

Different aspects of the various embodiments of the invention will become apparent from the following specification, drawings and claims in which:

The drawings are not necessarily to scale. Like numbers refer to like parts or steps throughout the drawings.

DETAILED DESCRIPTION OF SOME EMBODIMENTS

Figure 1:
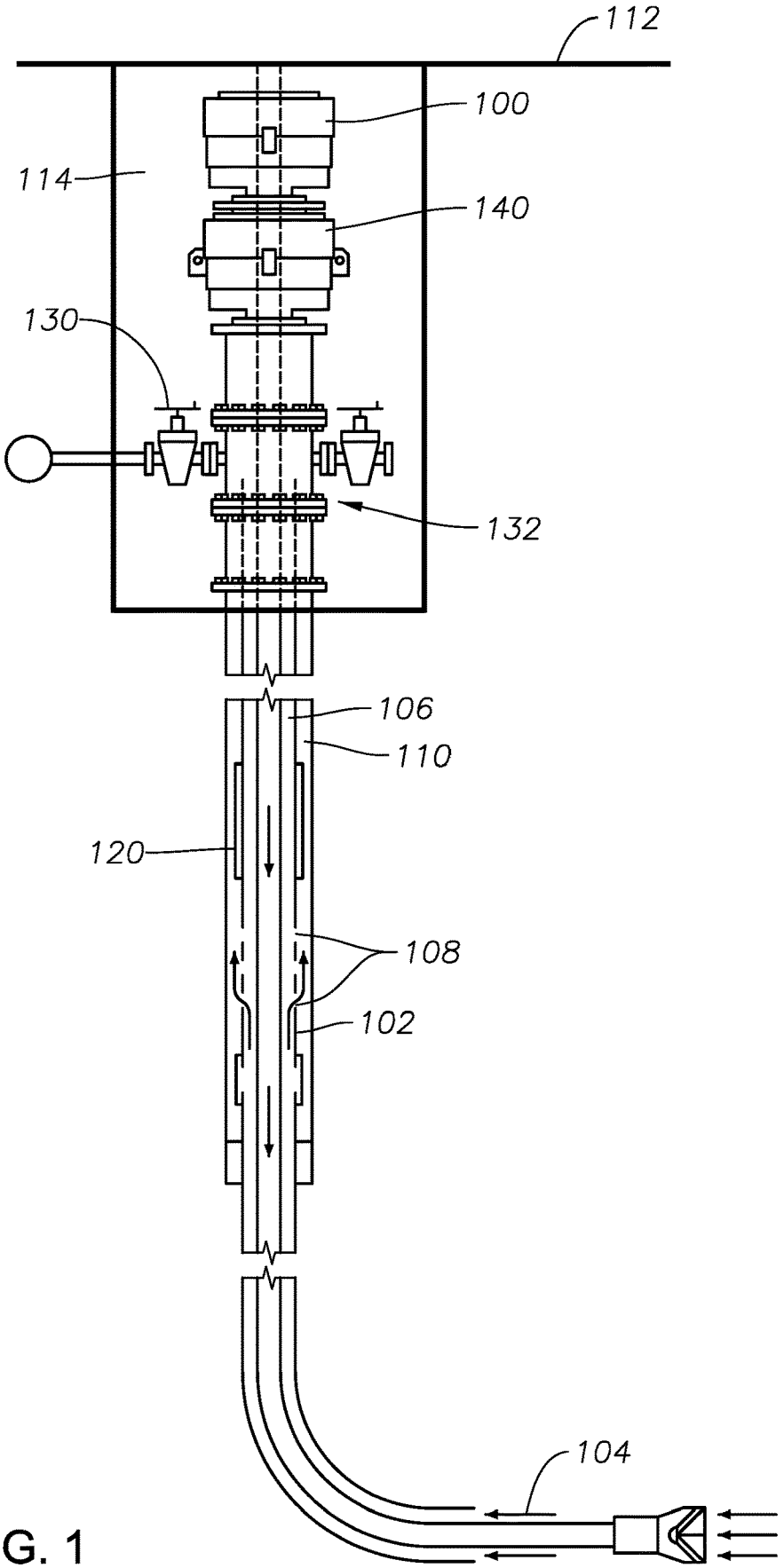
FIG. 1 shows the configuration of devices used in the Annular Pressure Cap Drilling method.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Referring now to the drawings, embodiments of the present invention will be described. The invention can be implemented in numerous ways. Several embodiments of the present invention are discussed below. The appended drawings illustrate only typical embodiments of the present invention and therefore are not to be considered limiting of its scope and breadth. In the drawings, some, but not all, possible embodiments are illustrated, and further may not be shown to scale.

The inventions described herein form part of a broader approach to near balanced reservoir drilling ("NBRD") which is described in the '144 patent. As detailed below, the inventions described herein enable various aspects of the NBRD approach to be carried out safely and efficiently. However, the inventions and embodiments thereof described herein and claimed below have applications in oil and gas well drilling and production far beyond the NRBD method. Any embodiments or applications of the inventions provided herein are intended as examples but are not intended to be taken as limitations.

As shown in FIG. 1, in the NBRD approach described in the above patent applications, an Annular Pressure Control Diverter 100 is installed to divert the return flow 104 of drilling and produced fluids from the conventional return path up the annulus 106 around the drill pipe, via ports 108 in the tie-back liner into an outer annulus 110 and hence to the wellhead 132. This equipment is often installed below the surface of the earth 112 in a "cellar" under the drilling platform. Maintenance operations such as changing the seals in the Annular Pressure Control Diverter 100 require that the Annular Pressure Control Diverter 100 be protected from the high pressure in the well. One way this can be done is by activating a sub-surface safety valve 120 when the drill bit and pipe have been pulled above the sub-surface safety valves. Some embodiments of the present invention are adapted to activate a flapper style sub-surface safety valve 120. Other embodiments are adapted to open and close the ports 108, temporarily halting the return and produced fluid flow, so that valves 130 at or proximate to the wellhead 132 can be checked, maintained, and if necessary, changed. These embodiments and others are discussed in detail below.

An alternative method of protecting the Annular Pressure Control Diverter 100 and changing the seals is to close an annular blowout preventer 140 below the Annular Pressure Control Diverter around the drill pipe. This approach has the advantage of allowing the seals to be changed without the need to pull the drill bit above the subsurface safety valves. As will be understood by one of normal skill in the art, a pipe ram blowout preventer could also be used for this purpose in place of the annular blowout preventer 140.

Figure 2:
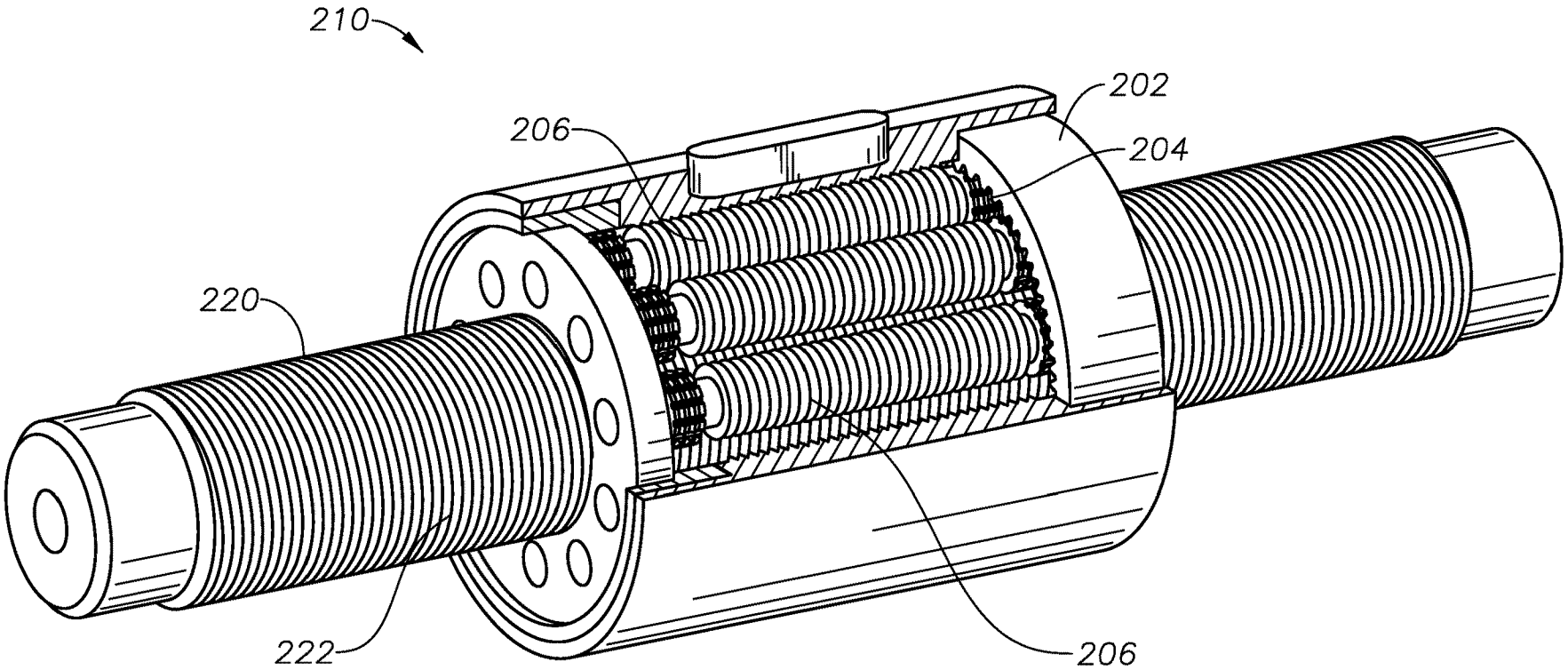
FIG. 2 shows a linear motion actuator.

FIG. 2 shows a simplified representation of some internal parts of the present invention to illustrate the operating principles. The present invention uses a rotating wellhead to provide an initial rotational force. Although rotating wellheads have been used for many years in a production environment, it is not standard industry practice to install a rotating wellhead for the drilling operations. See, for example, U.S. Pat. No. 5,429,188 to Cameron et al., entitled "Tubing Rotator for a Well" the disclosure of which is incorporated herein by reference in its entirety. This patent describes a common production application, that is, rotating the production tubing to avoid wear on one part of the tubing from the rotating rod strings used in rotary pumps. This technique requires constant, very slow rotation, whereas NBRD requires occasional relatively rapid rotation for just a few turns.

The device shown in FIG. 2 is commonly known as a "linear motion actuator" or "roller screw". The rotational force is applied at the surface to the rotating wellhead and transferred via the casing to a tubular member 202, which in some of the embodiments described herein is a tieback liner. The rotating wellhead may be powered hydraulically or electrically. It must, for the applications described below, be capable of rotating in either direction. At a predetermined depth downhole, the tubular member 202 is equipped with internal threads 204. The internal threads 204 mesh with a plurality of threaded rollers 206 positioned around the inside of the tubular member 202 to form a linear motion actuator 210. Contained within the plurality of threaded rollers 206 is an inner cylindrical member 220, which may be solid or hollow, and which possesses external threads 222. These external threads mesh with the threads on the plurality of threaded rollers 206. When the tubular member 202 rotates, it causes the plurality of threaded rollers 206 to rotate, and the rotation is transferred to the inner cylindrical member 220. The inner cylindrical member 220, as it rotates, moves linearly up or down the wellbore. In this manner, a rotational motion at the rotating wellhead is converted to an axial motion downhole. Because this system is entirely mechanical, rather than hydraulic, it can be operated at almost any depth. The force exerted by the actuator does not vary with depth. When a linear motion actuator is used during drilling operations, as in the embodiments described herein, the cylindrical inner member 220 is hollow to permit a drill string and bit to be passed through it.

To implement the embodiments described herein, a wellhead 132 is installed using normal industry methods. Intermediate casing, typically 9⅝" in diameter, is set from this wellhead 132. Then a 5½" production casing is set in a rotating wellhead. This pipe is normally referred to as a tie-back liner, and usually extends all the way down the wellbore to the tie-back receptacle. Other casing sizes may be used.

Figure 3:
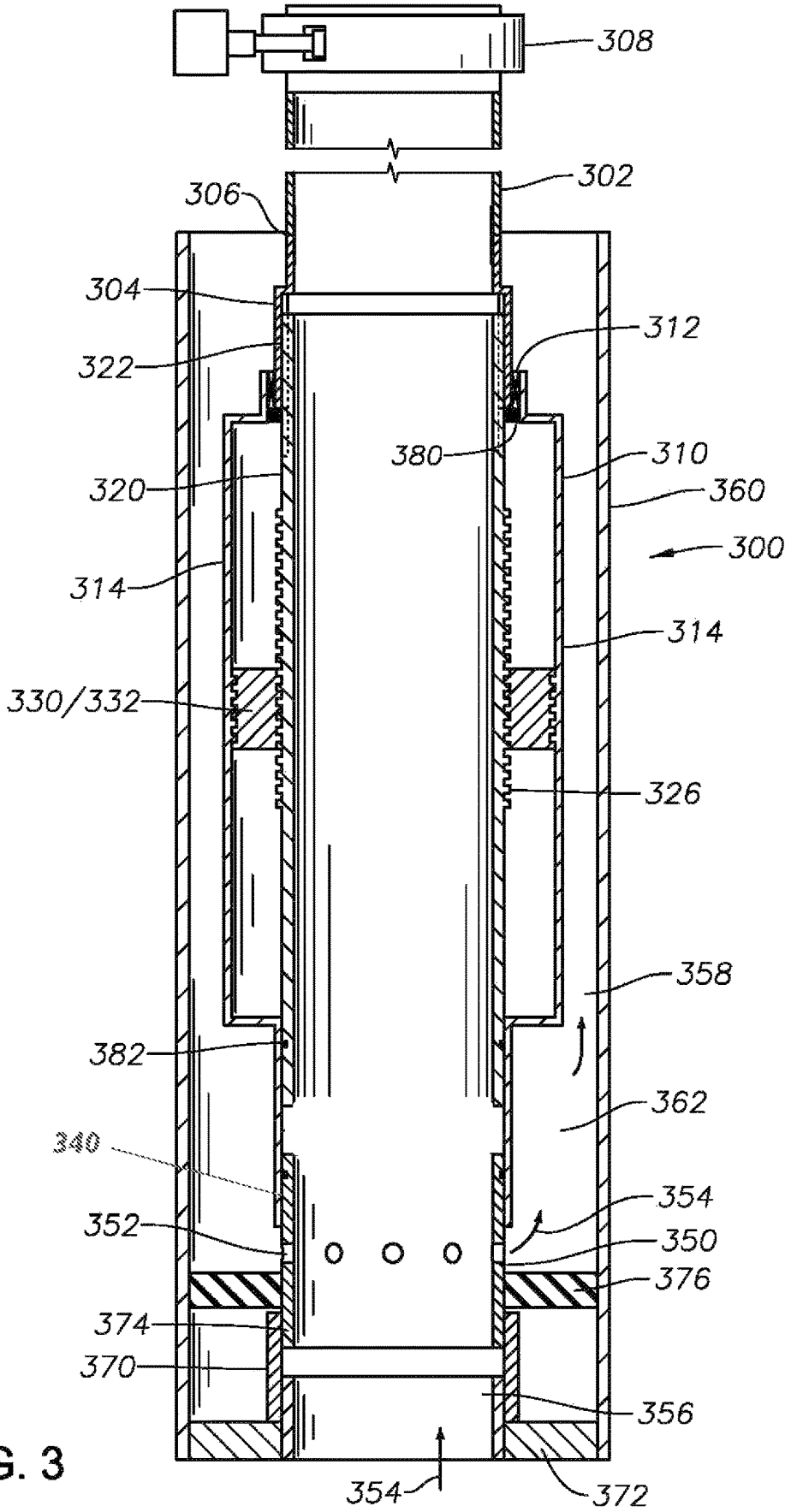
FIG. 3 shows the inner configuration of the sub-surface safety valve and linear motion actuator.

FIG. 3 shows one possible embodiment of the mechanical actuator 300. At the top of FIG. 3 is the 5.5" tie-back liner casing 302, which extends all the way back up to the rotating wellhead 308, and rotates with it. The tie-back liner casing 302 is attached to an upper member 304 of the mechanical actuator housing 310 by a Poly-Union connection 306, so that these two components rotate together. The upper member 304 of the mechanical actuator housing 310 is connected to the lower section 314 of the mechanical actuator housing 310 by an adjustable rotary union 312, which allows the upper member 304 of the mechanical actuator housing 310 to rotate while the lower section 314 of the mechanical actuator housing 310 remains stationary. A mechanical linear motion actuator 320 is connected to the upper member 304 of the mechanical actuator housing 310 by an upper splined travel joint 322. This type of joint allows the upper member 304 of the mechanical actuator housing 310 and the mechanical linear motion actuator 320 to move vertically with respect to each other, while remaining locked together to transmit the rotation from the upper member 304 of the mechanical actuator housing 310 to the mechanical linear motion actuator 320.

The outside of the mechanical linear motion actuator 320 is configured with threads 326, which engage with a plurality of threaded rollers 330 mounted within the mechanical actuator housing 310, forming the linear motion actuator 332. The threaded rollers 330 can rotate but cannot travel vertically. Therefore as the mechanical linear motion actuator 320 rotates within the threaded rollers 330, it moves vertically up or down, depending on the direction in which it is rotating. The linear axial motion is precisely controlled by the amount of rotation of the rotating wellhead, and the pitch of the threads 326 on the mechanical linear motion actuator 320 and threaded rollers 330.

A lower splined travel joint 340 is used at the base of the mechanical actuator housing 310 to allow it to move up and down within the non-rotating lower portion 350 of the tie-back liner casing 302. The lower portion 350 of the tie-back liner casing 302 contains the ports 352 or perforations required in this drilling approach to enable the return fluid 354 to flow from the inner annulus 356 between the tie-back liner casing 302 and the drill pipe and into the outer return fluid annulus 358 between the tie-back liner casing 302 and the intermediate casing 360.

The entire assembly, including the upper portion of the tie-back liner casing 302, the mechanical actuator housing 310, and the lower portion 350 of the tie-back liner casing 302, is lowered into the tie-back receptacle 370, which is supported on a hanger 372. A seal bore assembly 374 ensures a tight connection, and as the assembly is lowered into position, it compresses a weight set packer 376 in the annulus 362 between the lower portion 350 of the tie-back liner casing 302 and the intermediate casing 360. Because the exact downhole location of the tie-back receptacle 370 may not be known, with a possible variation of a few inches or even a few feet, the lower splined travel joint 340 provides sufficient travel to accommodate this uncertainty.

The lower splined travel joint 340 is equipped with a packer or anchor with slips configured to activate when the lower travel joint reaches the bottom of the wellbore, the lower travel joint 340 being in its collapsed position. Weight is applied to set the packer or anchor. This step is critical to prevent the mechanical actuator housing 310 from rotating, ensuring that the mechanical linear motion actuator 320 rotates within the mechanical actuator housing 310 as the tie-back liner casing 302 is rotated by the rotating wellhead.

In some embodiments, upper seals 380 and lower seals 382 are installed at the points where the mechanical linear motion actuator 320 rotates within the mechanical actuator housing 310.

It should be noted that the two splined travel joints perform different functions. The upper splined travel joint 322 connects two components, allowing a range of vertical motion while ensuring that the two components rotate together, thereby transmitting the rotational forces from the rotating wellhead. The lower splined travel joint 340 connects two components, allowing a range of vertical motion while ensuring that the upper component does not rotate within the lower component.

One of the applications in which the mechanical linear motion actuator 320 is used is in opening a sub-surface safety valve. In the drilling method described in the '144 patent, and illustrated in FIG. 1, the Annular Pressure Control Diverter 100 contains seals which may need to be changed. Because the Annular Pressure Control Diverter 100 is the primary pressure control mechanism for the well, a means must be provided to block the pressure at a point below the Annular Pressure Control Diverter 100 in order to allow the seals to be removed and replaced. One such means is a sub-surface safety valve 120, which is capable of blocking the tie-back liner and containing the well pressure. Blocking the pressure using a flapper valve, which completely closes off the tie-back liner, requires pulling the drill string above the level of the flapper valve.

Figure 4:
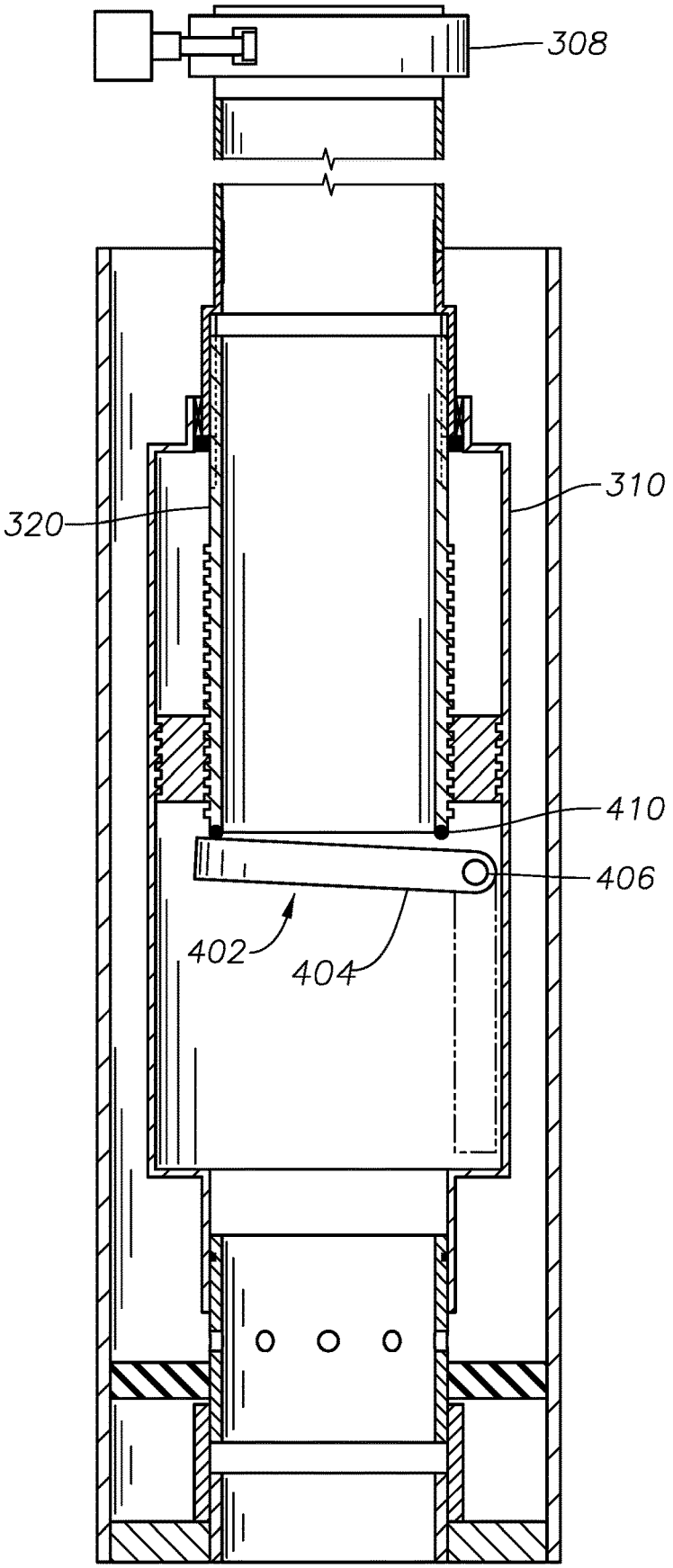
FIG. 4 shows a linear motion actuator operating an obtuse angle flapper valve.

As shown in FIG. 4, in these embodiments, the mechanical linear motion actuator 320 is shortened from the version shown in FIG. 3. A flapper valve 402 is positioned inside the mechanical actuator housing 310 and below the mechanical linear motion actuator 320. A flapper 404 is rotatably connected via a hinge 406 to the inner surface of the mechanical actuator housing 310. As the mechanical linear motion actuator 320 is moved downwards, it impinges on the flapper 404, which rotates about the hinge 406 and opens the flapper valve 402, forcing the flapper 404 parallel with the inner surface of the mechanical actuator housing 310.

The position of the flapper 404 when closed as shown in FIG. 4 forms an obtuse angle with the position of the flapper 404 when open. That is, when the flapper valve 402 is closed, the edge of the flapper 404 furthest from the hinge 406 is higher than the edge of the flapper 404 closest to the hinge 406. This feature, not seen in the prior art, ensures that the mechanical linear motion actuator 320 first contacts the flapper 404 at a point on the flapper 404 opposite the hinge 406. The optimal leverage thus afforded ensures that the mechanical linear motion actuator 320 will exert the maximum possible force to open the flapper valve 402. The pressure on the bottom of the flapper 404 which has to be overcome can be considerable, sometimes thousands of PSI.

For an example of the earlier type of flapper valve, without this improvement, see U.S. Pat. No. 4,433,702 to Baker, entitled "Fully Opening Flapper Valve Apparatus", the disclosure of which is incorporated herein by reference in its entirety.

In some embodiments, the lower end of the mechanical linear motion actuator 320 is equipped with bearings 410, so that the lower end of the mechanical linear motion actuator 320 which contacts the flapper 404 does not rotate in direct contact with the flapper 404 and cause wear. In other embodiments, the upper surface of the flapper 404 contains bearings for the same purpose. In yet other embodiments, the upper surface of the flapper 404 is contoured so as to optimize the contact between the upper surface of the flapper 404 and the lower end of the mechanical linear motion actuator 320. It is not possible to configure a contour on the lower end of the mechanical linear motion actuator 320, because in these embodiments, the mechanical linear motion actuator 320 is rotating.

The flapper valve 402 will most often be in the open position with the flapper parallel to the inner surface of the mechanical actuator housing 310, to permit the drill string to pass through it.

In some embodiments, the flapper 404 retracts into a cut-away section of the inner surface of the mechanical actuator housing 310 so that it does not interfere with the motion of the drill string.

If an additional level of safety or redundancy is required, two flapper valve assemblies may be installed, one above the other. During drilling operations, both valves are open and the actuator is in its lowest position. During maintenance operations, after the drill string has been raised above the flapper valves, withdrawing the actuator upwards allows the lower valve to close, then the upper valve may also optionally be closed by further upward motion of the actuator.

Figure 5:
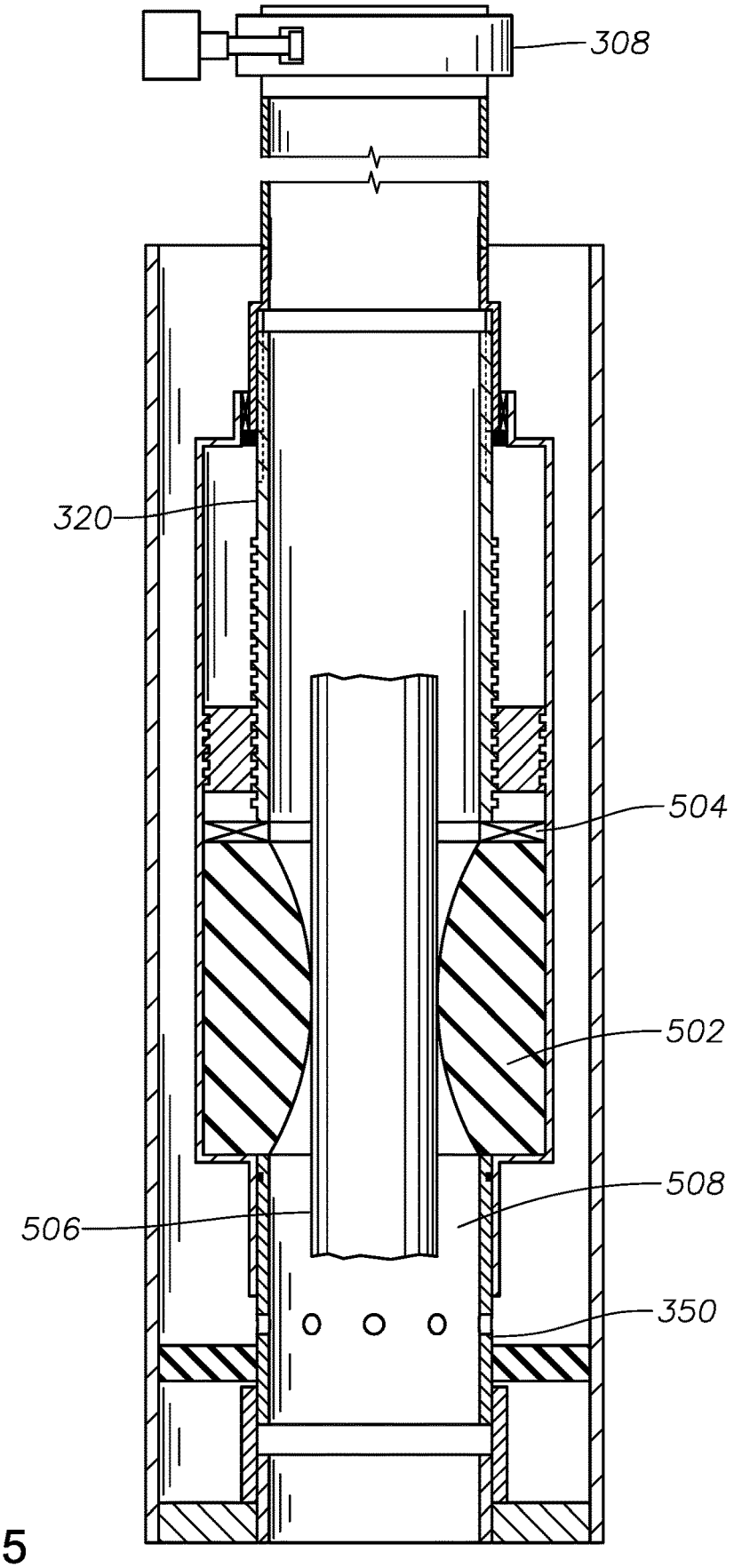
FIG. 5 shows a linear motion actuator operating a bladder valve.

In some operations, it is necessary to block the pressure in the well downhole while the drill string is present. FIG. 5 shows one embodiment of how this can be done using the mechanical linear motion actuator 320 to compress a bladder 502 by exerting downward force through a thrust bearing 504. The thrust bearing 504 is used to reduce wear on the bladder from the actuator which is rotating as it moves down. The force exerted on the bladder results in the bladder compressing axially and expanding laterally, thus gripping the drill pipe and sealing the annulus 510 between the drill pipe 506 and the non-rotating lower portion 350 of the tie-back liner.

The bladder 502 may be made of polyurethane. Polyurethane has properties which make it especially suitable for this application. That is, polyurethane is highly compressible and can regain its original shape when the compression is released. Therefore when the mechanical linear motion actuator 320 is moved uphole, the bladder 502 will quickly revert to its original shape, releasing its grip on the drill pipe and opening the annulus around the drill pipe.

Polyurethane is also highly stretchable, extending in some cases to up to six times its normal dimension with the ability to quickly revert to its original shape. Polyurethane is also highly resistant to wear, and is to some extent self-lubricating. Different types of polyurethane have varying resistance to high temperatures, so it is easy to obtain the right type for a given application. And, of course, polyurethane is not affected by oil and gas.

Yet another use for the linear motion actuator is to block the ports 352 through which the return fluid flow is diverted into the annulus between the tie-back liner casing 302 and the intermediate casing 360. This may be necessary in order to change the valves 130 which control the flow to a separator, or in an emergency, or if the produced fluids are being stored locally and storage capacity limits are approached.

Figure 6:
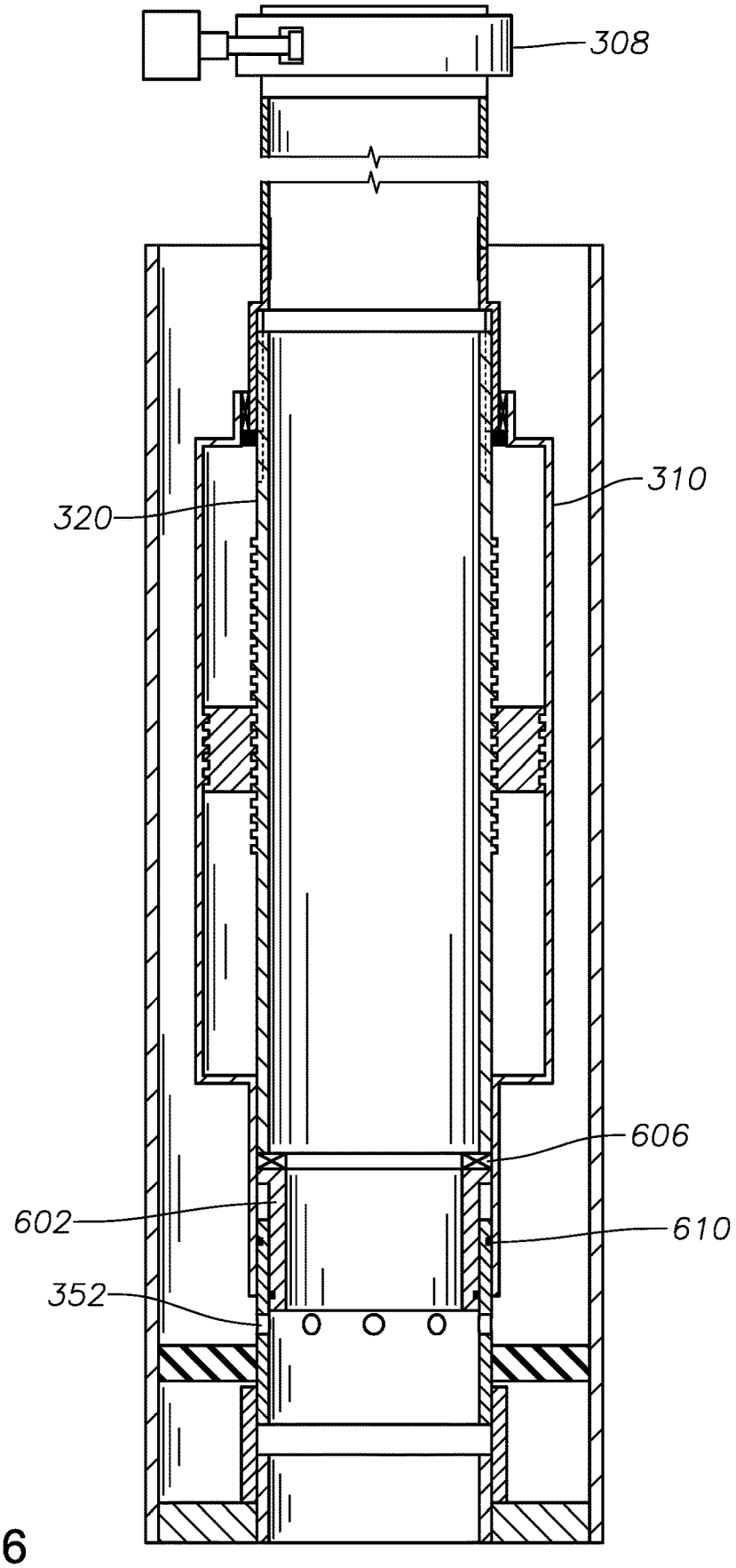
FIG. 6 shows a linear motion actuator operating a sliding sleeve valve.

As shown in FIG. 6, in these embodiments, the mechanical linear motion actuator 320 is extended such that as it moves downwards, it activates a sliding sleeve valve 602 which blocks the ports 352. In some embodiments, where the mechanical linear motion actuator 320 is connected to the sliding sleeve valve 602, as the mechanical linear motion actuator 320 is moved upward, it opens the sliding sleeve valve 602. In other embodiments, where the mechanical linear motion actuator 320 is not connected to the sliding sleeve valve 602, one or more springs below the sliding sleeve valve 602 force the sleeve 604 upwards and open the ports 352 to allow the return fluid flow to resume.

The mechanical linear motion actuator 320 will be rotating as it comes into contact with the top of the sliding sleeve valve 602. As the rotating and non-rotating surfaces make contact and operate the sliding sleeve valve 602, there will be some friction and some wear on the surfaces. This is not expected to be an issue, as the mechanical linear motion actuator 320 will only rotate a few revolutions, and the surfaces are parallel, spreading the forces evenly. Further, it is not expected that this apparatus will be used frequently, or on a regular basis. Nevertheless, in some embodiments, there may be a bearing 606 installed on the bottom of the mechanical linear motion actuator 320 or the top of the sliding sleeve valve 602.

Seals 610 at the bottom of the sliding sleeve valve 602 prevent fluid flow between the mechanical linear motion actuator 320 and the inside of the sub-surface valve housing 310.

Multiple embodiments of this valve assembly are possible. In some embodiments, the sliding sleeve valve will normally be closed, in others, normally open. In some embodiments, the sliding sleeve valve is opened by downward travel of the actuator, and in other embodiments the sliding sleeve valve is closed by the downward travel of the actuator. It is possible to produce embodiments in which the sliding sleeve, as it is actuated, opens some ports while closing others.

It is also possible to combine more than one of the above applications of the mechanical linear motion actuator and associated valves. For example, downward motion of the actuator could open a sub-surface flapper valve, through which a drill string is passed, then further motion of the actuator could operate a compressible bladder to block the annulus between the drill string and the tie-back liner. In another possible embodiment, downward motion of the actuator could open a sub-surface flapper valve, through which a drill string is passed, then further motion of the actuator could operate a sliding sleeve valve. In yet other embodiments, sliding sleeve valves or compressible bladders may be operated by the upper end of the actuator, suitably modified with flanges.

It should be noted that the above are just some embodiments illustrating how the linear motion actuator be employed to operate various equipment at significant depths in a well. One of ordinary skill in the art, after reading this specification and studying the drawings, will appreciate that there are many ways in which this type of mechanical actuator may be used, and will quickly grasp its advantages and benefits compared to older hydraulic methods of operating such equipment, especially when the depth at which the equipment is being operated is in the thousands of feet.

What is claimed is:

1. A system for applying an axial force downhole in a well comprising:

a rotating wellhead;

a casing having an upper end and a lower end, the upper end attached to and rotating with the rotating wellhead;

a mechanical actuator housing having a rotatable upper member attached to the lower end of the casing and rotating with the casing and a lower section which does not rotate, the upper member rotatably connected to the lower section by an adjustable rotary union;

a linear motion mechanical actuator connected to the rotatable upper member of the mechanical actuator housing by an upper joint which transfers torque while allowing for extension wherein the rotation of the rotating wellhead is transferred through the casing and upper member of the mechanical actuator housing via the upper joint to the linear motion mechanical actuator and the lower section of the mechanical actuator housing is supported by a tie-back liner through a lower joint which transfers torque while allowing for extension to prevent rotation and to laterally stabilize the lower section of the mechanical actuator housing.

2. The system of claim 1, wherein the upper joint which transfers torque while allowing for extension is a splined travel joint, thereby transmitting the rotation of the upper part of the mechanical actuator housing to the linear motion mechanical actuator while allowing a range of vertical motion of the linear motion mechanical actuator relative to the upper part of the mechanical actuator housing.

3. The system of claim 1, wherein the linear motion actuator further comprises a plurality of roller gears able to rotate on their axes and rotate within a circular housing concentric within and attached to the inside of the mechanical actuator housing.

4. The system of claim 1 wherein the linear motion mechanical actuator further comprises a hollow cylindrical actuator having threads on its external surface which mesh with the plurality of roller gears.

5. The system of claim 4 wherein the hollow cylindrical actuator is of sufficient internal diameter to allow the passage of a drill string through the hollow cylindrical actuator.

6. The system of claim 1 wherein the lower joint which transfers torque while allowing for extension is a splined travel joint connecting the lower part of the mechanical actuator housing to the tie-back liner permitting a range of vertical motion while preventing the lower part of the mechanical actuator housing from rotating within the tie back liner.

7. A sub-surface safety valve assembly comprising:

a rotating wellhead;

a casing having an upper end and a lower end, the upper end attached to and rotating with the rotating wellhead;

a mechanical actuator housing having a rotatable upper member attached to the lower end of the casing and rotating with the casing and a lower section which does not rotate, the upper member rotatably connected to the lower section by an adjustable rotary union;

a linear motion mechanical actuator connected to the rotatable upper member of the mechanical actuator housing by a joint which transfers torque while allowing for extension wherein the rotation of the rotating wellhead is transferred through the casing and upper member of the mechanical actuator housing via the joint to the linear motion mechanical actuator, the linear motion mechanical actuator having a hollow cylindrical actuator and a hinged flapper valve disposed within the casing such that downward motion of the hollow cylindrical actuator opens the flapper valve.

8. The sub-surface safety valve of claim 7 wherein the hinged flapper valve in the open position forms an obtuse angle relative to the hinged flapper valve in the closed position.

9. The sub-surface safety valve of claim 7 wherein the side of the hinged flapper valve furthest from the hinge is higher than the side of the hinged flapper valve next to the hinge when the hinged flapper valve is in the closed position.

10. The sub-surface safety valve of claim 7 wherein the upper surface of the hinged flapper is curved to maximize the contact area with the base of the hollow cylindrical actuator.

11. The sub-surface safety valve of claim 7 wherein the lower end of the hollow cylindrical actuator is equipped with bearings to reduce wear on the upper surface of the hinged flapper valve.

* * * * *